US005566687A

United States Patent [19]

Trapanovski

[11] Patent Number: 5,566,687

[45] Date of Patent: Oct. 22, 1996

[54] HAIRDRESSER'S COMB

[76] Inventor: Tomislav Trapanovski, 22 Canterbury Trail, Fairport, N.Y. 14450

[21] Appl. No.: 529,682

[22] Filed: Sep. 18, 1995

[51] Int. Cl.[6] ..... A45D 24/00

[52] U.S. Cl. ..... 132/148; 132/149; 132/150; 132/75.4; 132/75.5; 30/30; 30/289; 30/295; 30/123

[58] Field of Search ..... 132/148, 149, 132/150, 75.4, 75.5; 30/30, 289, 295, 123

[56] References Cited

U.S. PATENT DOCUMENTS 995,194 6/1911 Stegemann ..... 132/148
2,589,230 3/1952 Davis et al. ..... 132/148
3,029,509 4/1962 Peters ..... 132/148
3,805,381 4/1974 Broussard, Sr. ..... 30/30
4,487,211 12/1984 Sullivan ..... 132/148

*Primary Examiner*—Gene Mancene
*Assistant Examiner*—Pedro Philogene
*Attorney, Agent, or Firm*—Robert J. Bird

[57] ABSTRACT

A hairdresser's comb includes, in its handle portion, an elongated aperture converging from a wide end to a narrow end. One sidewall of the aperture includes a lengthwise blade. The opposite sidewall has a serrated surface. A bottle tip inserted into the wide end of the aperture is pushed or rolled against the blade to sever the tip.

2 Claims, 1 Drawing Sheet

HAIRDRESSER'S COMB

FIELD OF THE INVENTION

This invention is a comb with an inserted blade for cutting the closure tips of bottles of liquid for the hair.

BACKGROUND AND IMFORMATION DISCLOSURE

Standard commercial hair procedures such as cutting, permanent waving, and coloring usually involve combing the hair, and at the same time applying to the hair certain liquids such as neutralizer, permanent lotion, or color. These liquids are typically packaged in thin tipped, small plastic bottles.

The typical procedure as presently performed requires the hairdresser to lay down the comb, pick up a knife or scissors, cut off the tip of a bottle of liquid, lay down the knife or scissors, and pick up the comb once again. This takes time, and it interrupts the flow of the procedure.

SUMMARY OF THE INVENTION

It is an object of this invention to include means for cutting such bottle tips as part of the hairdresser's comb, permitting the hairdresser to keep the comb in hand while applying liquids to the hair.

A hairdresser's comb according to this invention includes, in its handle portion, an elongated aperture converging from a wide end to a narrow end. One sidewall of the aperture Includes a lengthwise blade. The opposite sidewall has a serrated surface. A bottle tip inserted into the wide end of the aperture is pushed or rolled against the blade to sever the tip.

DRAWING

DESCRIPTION OF PREFERRED EMBODIMENT

Figure 1:
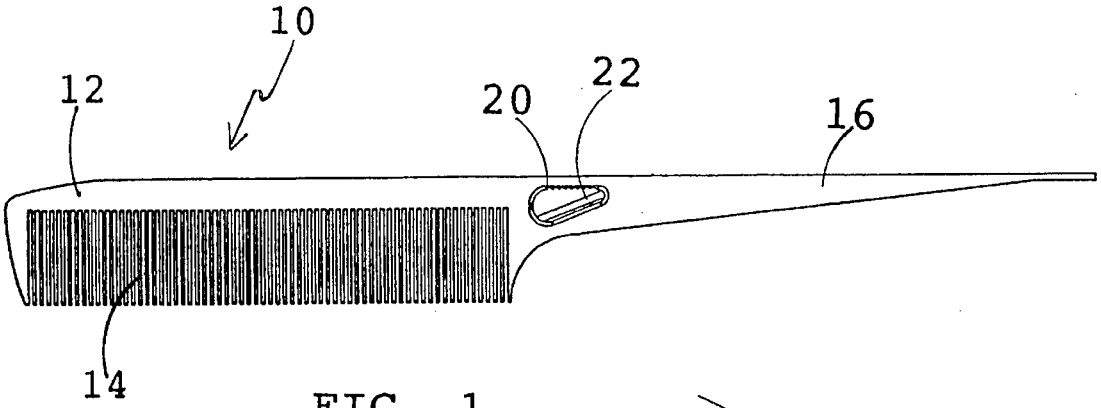
FIG. 1 is a side view of a hairdresser's comb according to this invention.

Referring now to the drawing, my comb 10 includes a comb section 12 with teeth 14 and an elongated handle 16. The forward portion of the handle 16 has enough bulk for easy gripping between thumb and forefinger. The handle 16 includes, in its forward portion, an elongated aperture 20 which is tapered in the direction of the length of the comb. Being wider at the comb end and narrower at the handle end.

A blade 22 extends along the lower sidewall 26 of the aperture 20 with its cutting edge 24 directed inward. The upper sidewall 28 of the aperture is preferably serrated as shown. The blade 22 and upper sidewall 28 converge at the narrow end of the aperture 20. The aperture 20 is small enough that the user's thumb and forefinger do not intrude into the aperture 20 and into contact with the cutting edge 24 of the blade 22.

Figure 2:
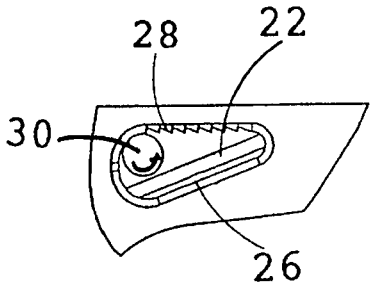
FIG. 2 is an enlarged detail from FIG. 1.
Figure 3:
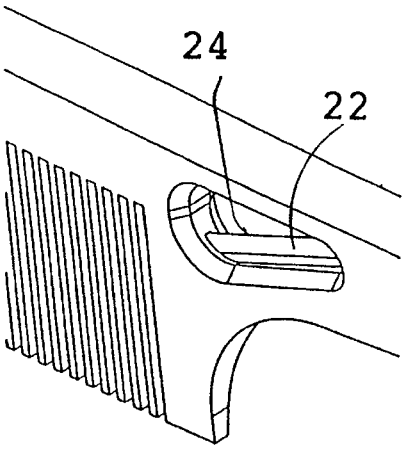
FIG. 3 is a still further enlarged pictorial view of that portion the comb including the detail of FIG. 2.

Referring to FIG. 2, the closure tip 30 of a bottle of hair liquid fits into the larger end of the aperture 20. Rotation of the bottle in the direction indicated by the arrow causes the tip 30 to roll along the serrated upper wall 28 and against the cutting edge 24, severing the tip 30. This dual purpose comb permits the hairdresser to Keep the comb in hand while opening and applying bottles of liquid to the hair.

The foregoing description of a preferred embodiment of this invention. including any dimensions, angles, or proportions, is intended as illustrative. The concept and scope of the invention are limited only by the following claims and equivalents thereof.

What is claimed is:

1. A hairdresser's comb including a comb section and a handle:

said handle including an elongated aperture with sidewalls converging from a wide end to a narrow end of said aperture;

a blade disposed within said aperture; along one of said sidewalls;

said wide end of said aperture adapted to receive a bottle closure tip: whereby, rotation of said closure tip within said aperture is effective to roll said tip against said blade to sever said closure tip.

2. A hairdresser's comb including a comb section and a handle:

said handle including an elongated aperture with sidewalls converging from a wide end to a narrow end of said aperture;

a blade disposed within said handle along one sidewall of said aperture:

a serrated surface on the sidewall of said aperture opposite said blade;

said wide end of said aperture adapted to receive a bottle closure tip:

whereby, rotation of said closure tip within said aperture is effective to roll said tip against said blade to sever said closure tip.

* * * * *